US007988493B2

(12) United States Patent
Taniguchi et al.

(10) Patent No.: US 7,988,493 B2
(45) Date of Patent: Aug. 2, 2011

(54) ELECTRICAL COMPONENT HOLDER

(75) Inventors: Takayuki Taniguchi, Yokkaichi (JP); Takeshi Yomura, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 88 days.

(21) Appl. No.: 12/379,593

(22) Filed: Feb. 25, 2009

(65) Prior Publication Data

US 2009/0247015 A1 Oct. 1, 2009

(30) Foreign Application Priority Data

Mar. 31, 2008 (JP) ..... 2008-093154

(51) Int. Cl.
*H01R 13/68* (2011.01)

(52) U.S. Cl. ..... 439/620.33; 439/76.2

(58) Field of Classification Search ..... 439/620.33, 439/620.26, 620.27, 620.34, 76.2
See application file for complete search history.

(56) References Cited

U.S. PATENT DOCUMENTS 5,171,293 A 12/1992 Umemoto et al.
5,488,345 A * 1/1996 Seki et al. ..... 337/186
5,816,858 A 10/1998 Kazarian et al.
6,033,252 A 3/2000 Hood et al.
6,059,609 A * 5/2000 Nieto ..... 439/620.27
7,425,151 B2 * 9/2008 Baba et al. ..... 439/567
7,445,509 B2 * 11/2008 Korczynski ..... 439/620.26
2006/0258223 A1 11/2006 Inaba et al.

FOREIGN PATENT DOCUMENTS

JP A-7-192600 7/1995

* cited by examiner

*Primary Examiner* — T C Patel
*Assistant Examiner* — Travis Chambers
(74) *Attorney, Agent, or Firm* — Oliff & Berridge, PLC

(57) ABSTRACT

An electrical component holder contains an electrical component to be connected to an internal circuit of a vehicle-installed electrical junction box. The holder has a casing main body and a lid to be mounted on an upper surface of the casing main body. The casing main body has a box-like configuration that is open at a lower end so that the casing main body can be placed on an electrical component mounting section of the electrical junction box. The casing main body has an upper wall that defines a through-hole that receives and holds a support portion of a terminal member of the electrical component. The support portion of the terminal member is inserted into and secured to the through-hole so that the terminal member projects into a hollow interior of the casing main body. The terminal member is inserted into and secured to a terminal aperture in the electrical component mounting section, under the condition that the casing main body is attached to the electrical component mounting section.

9 Claims, 12 Drawing Sheets

【Fig. 1】
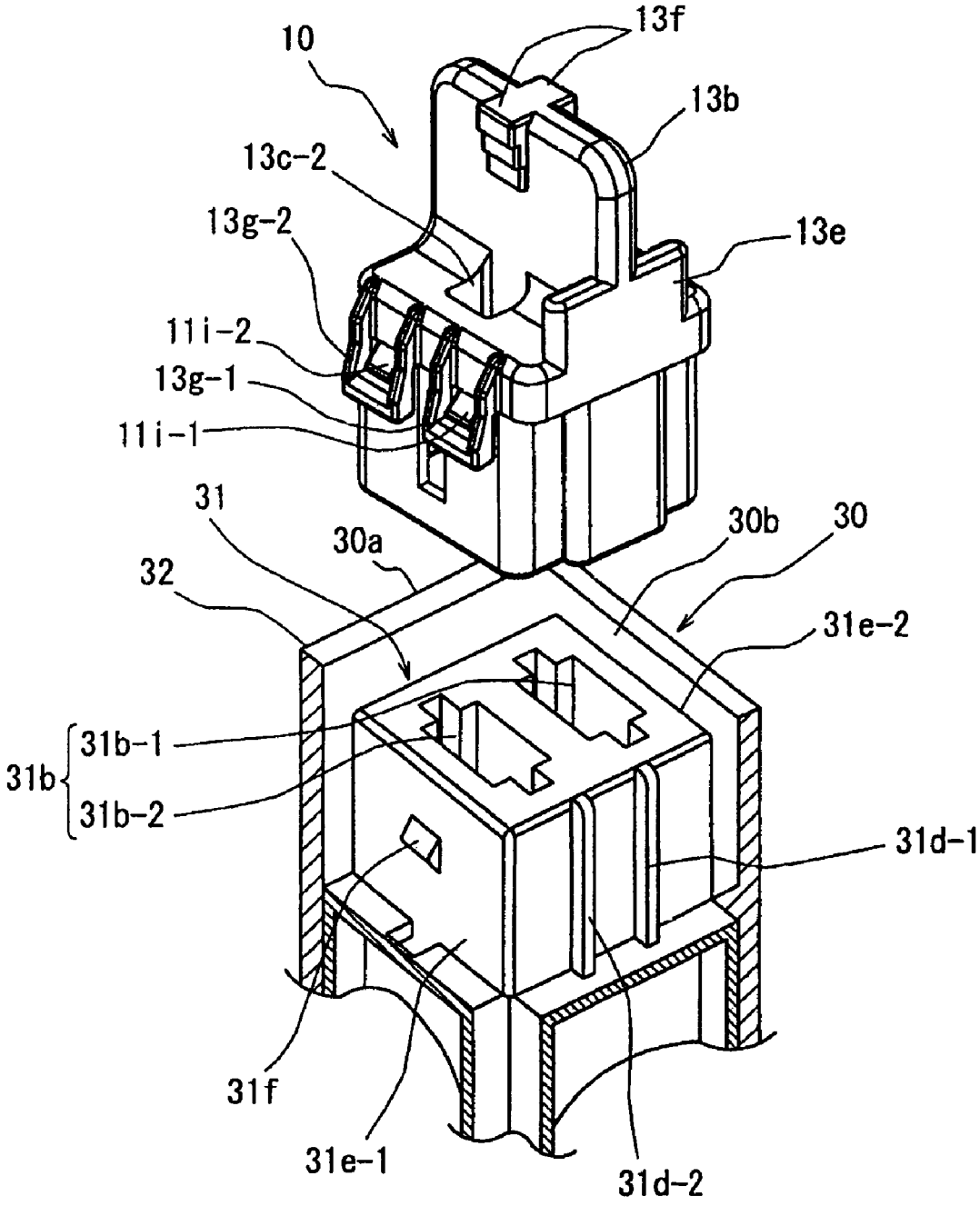

【Fig. 2】
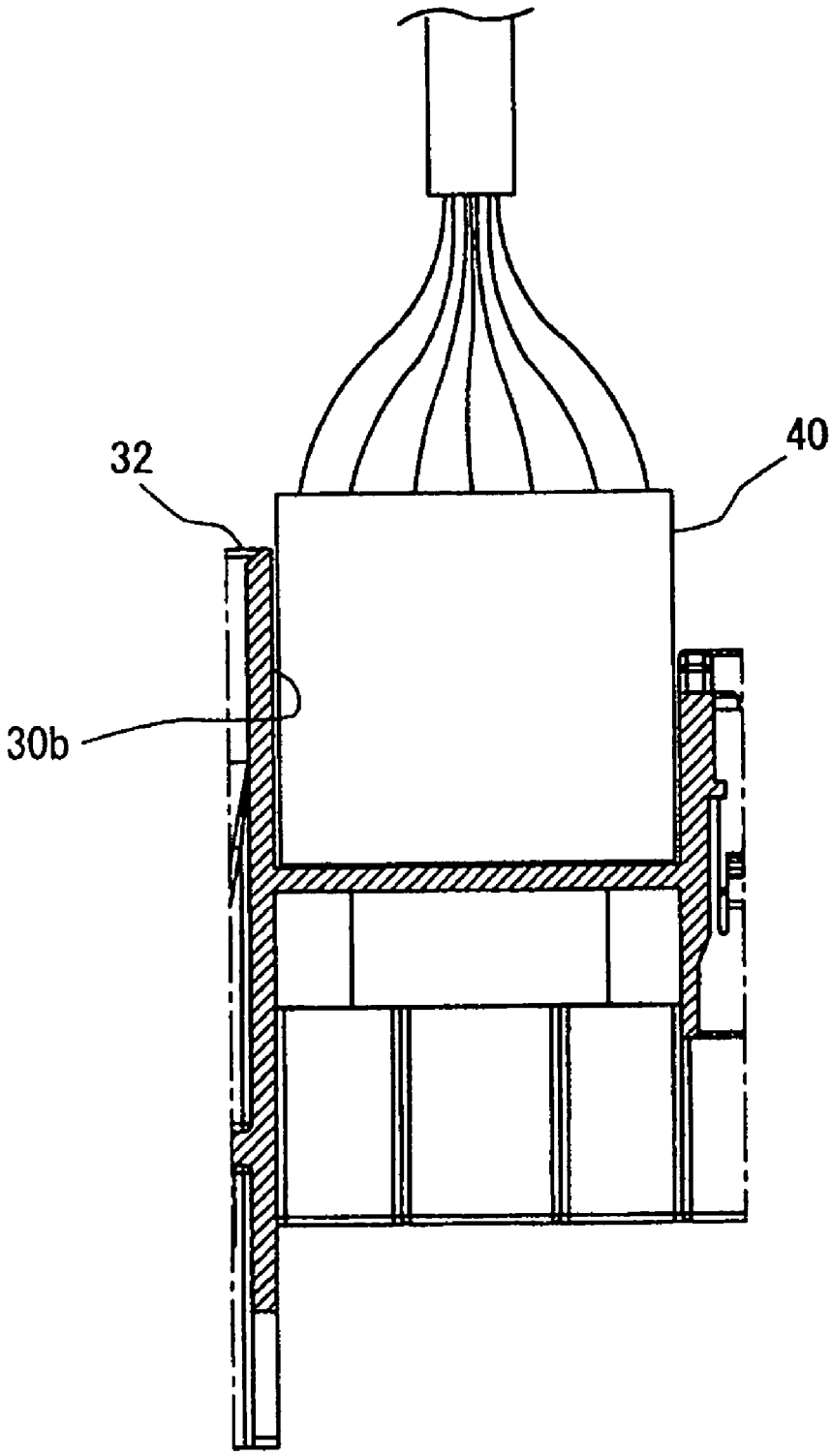

【Fig. 3】
(A)
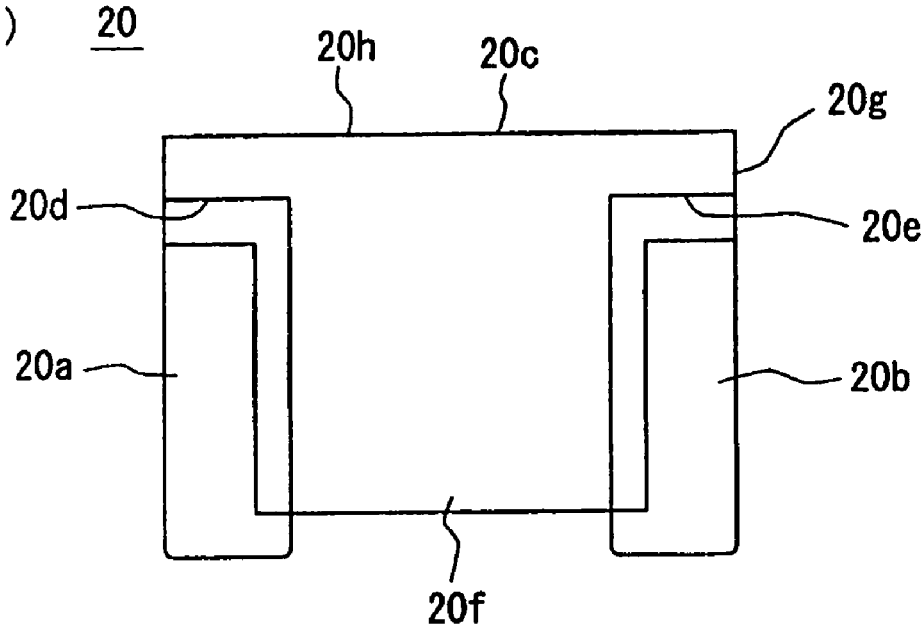
(B)
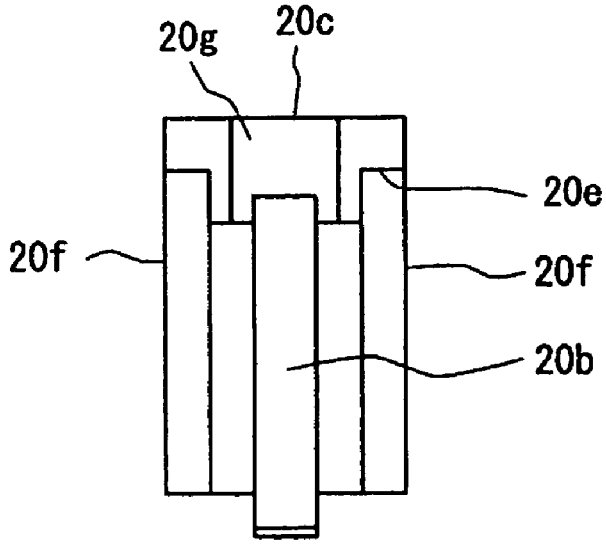

【Fig. 4】
(A)
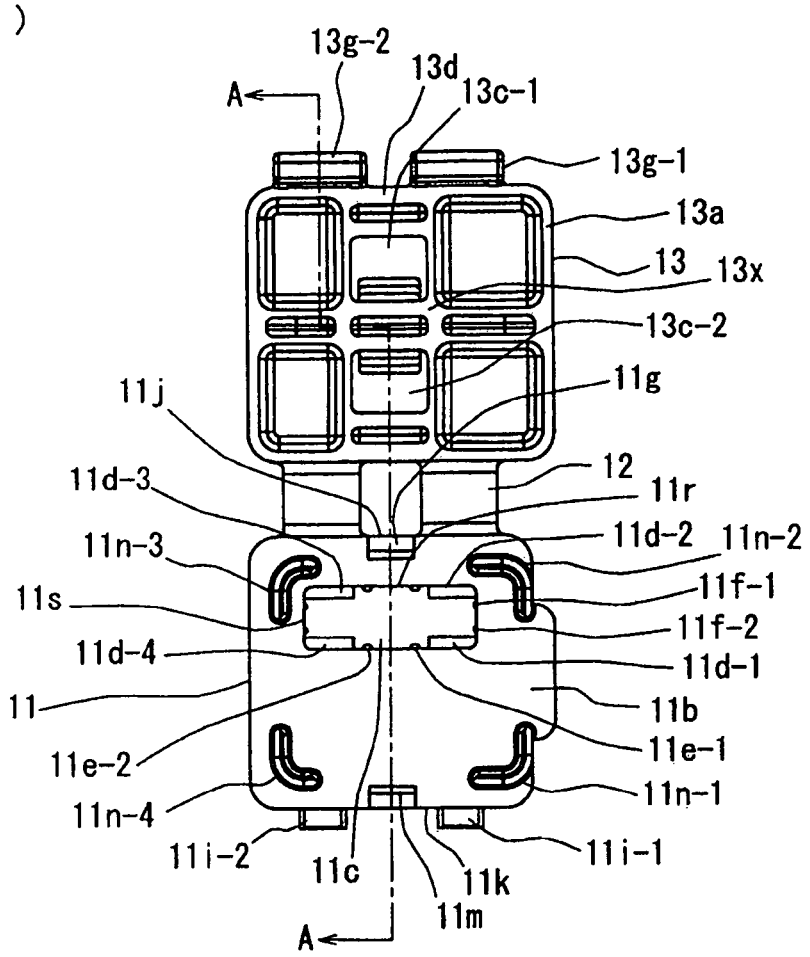
(B)
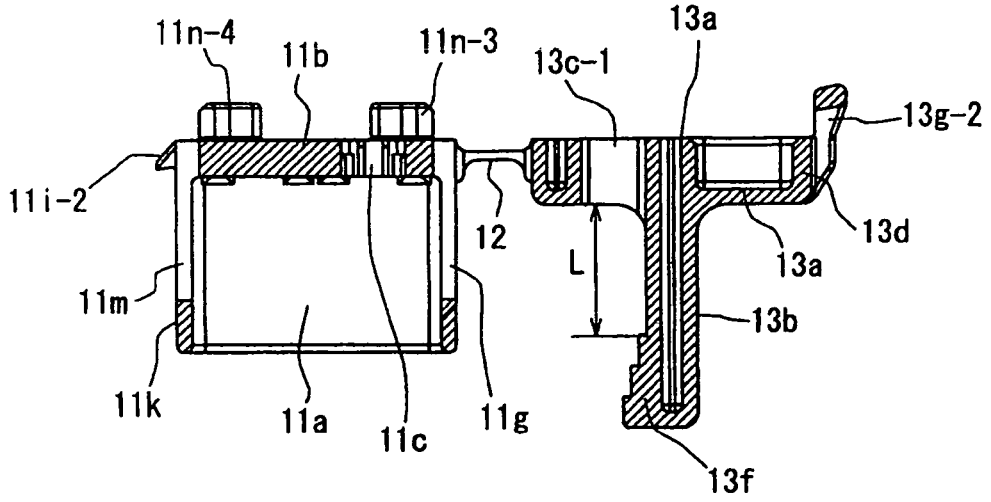

【Fig. 5】
(A)
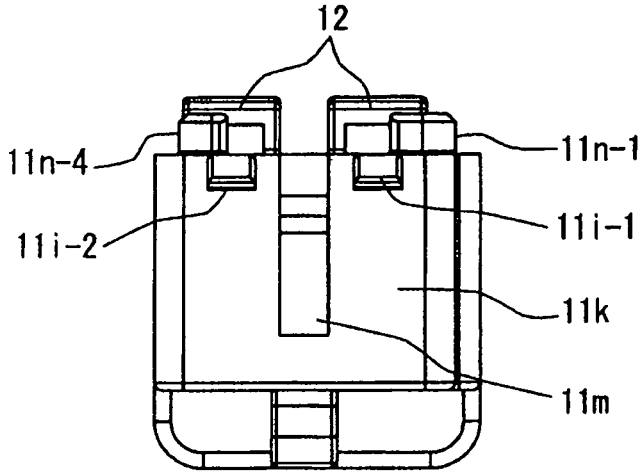
(B)
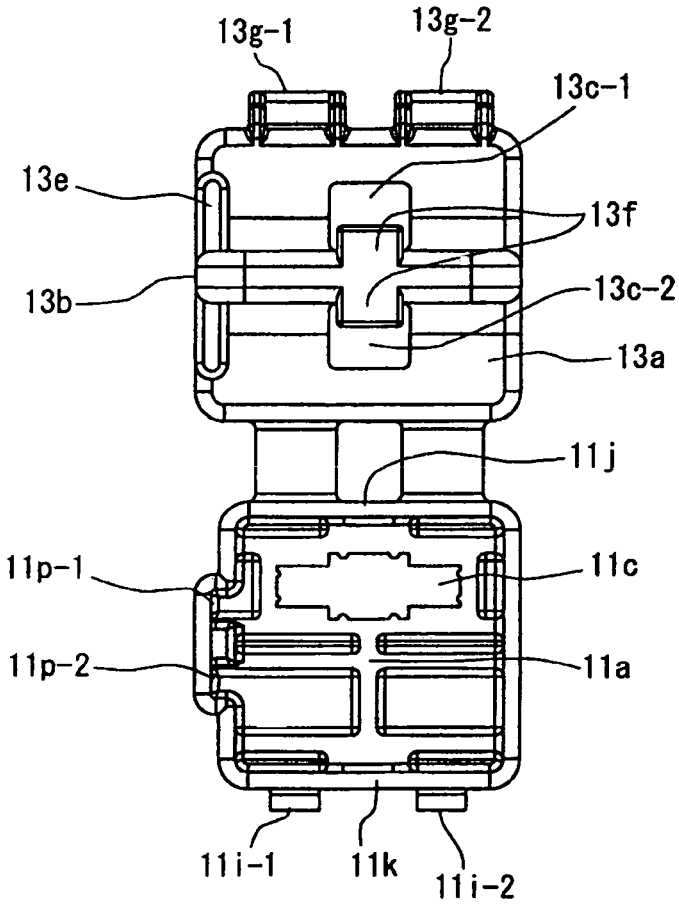

【Fig. 6】
(A)
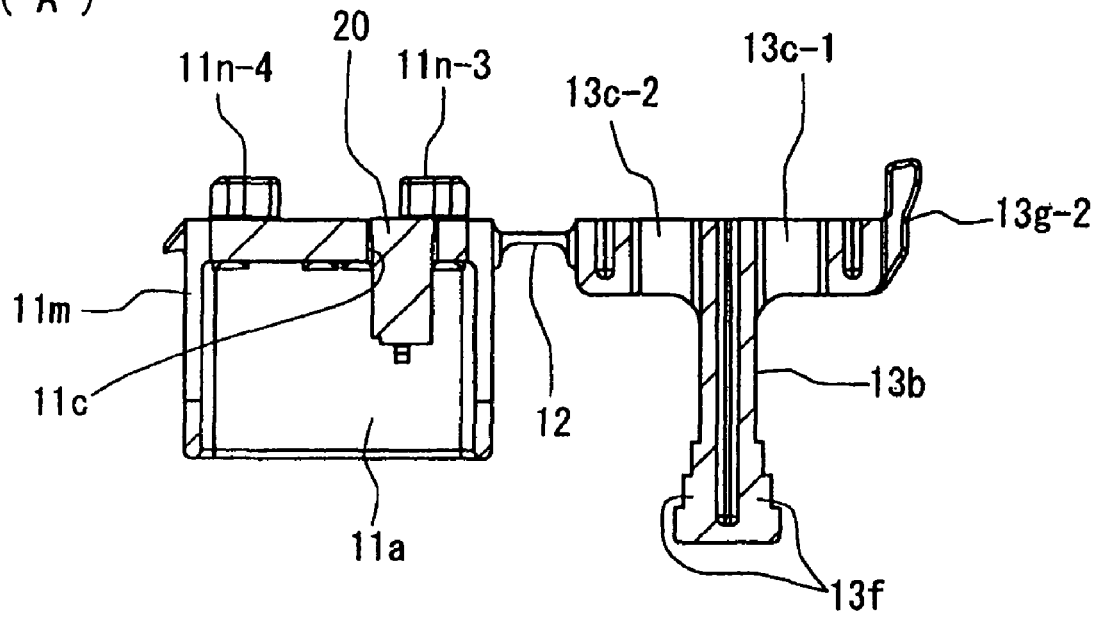
(B)
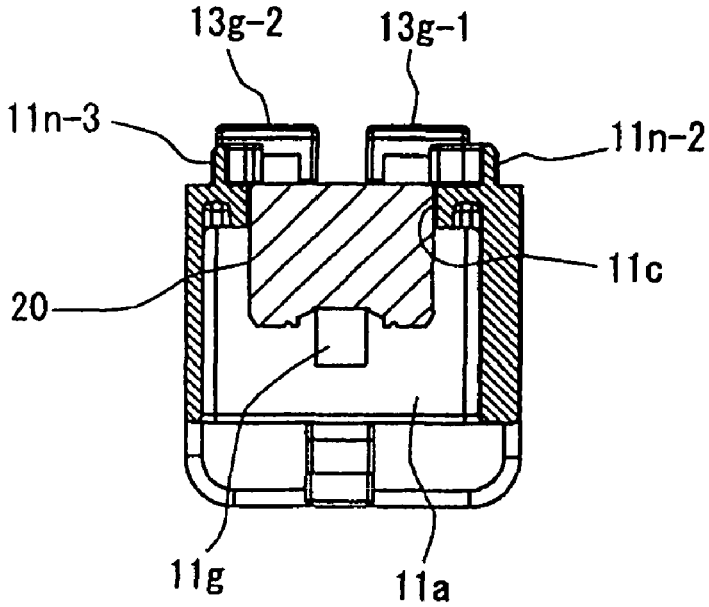

【Fig. 7】
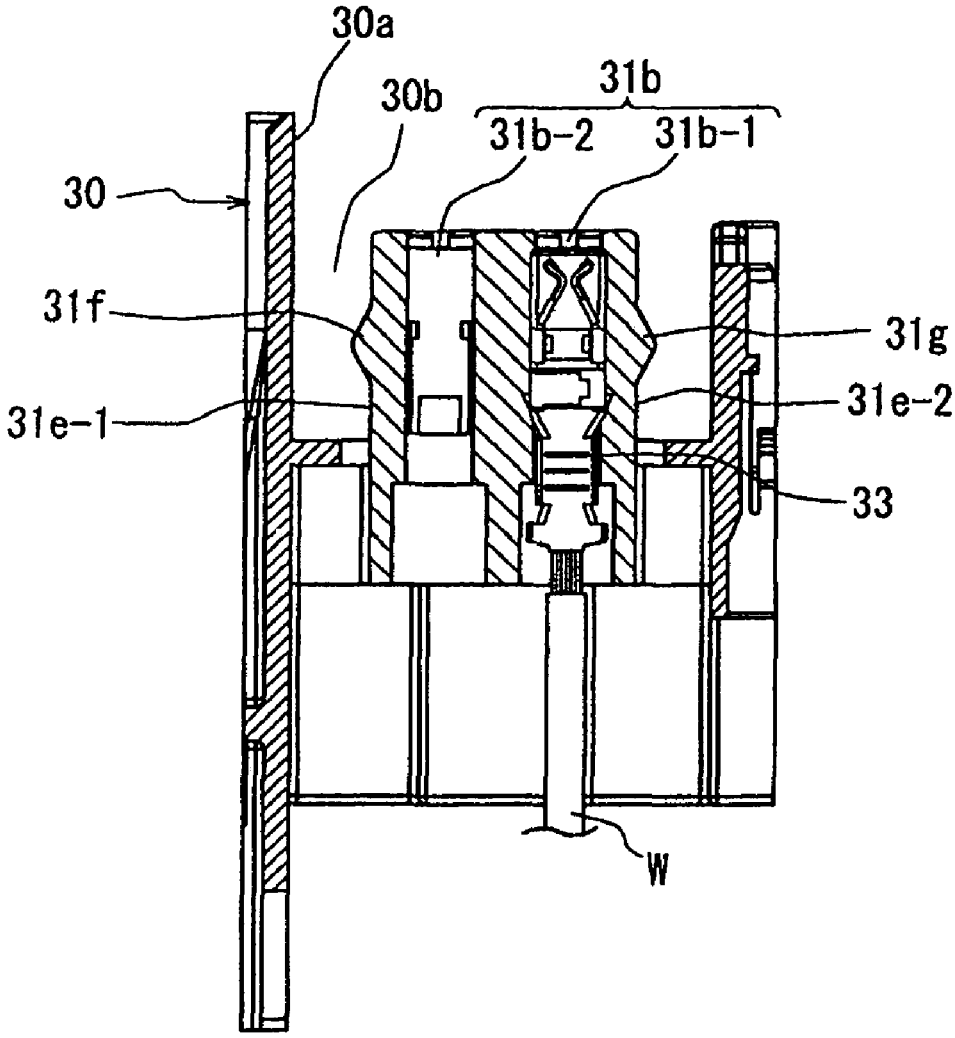

【Fig. 8】
(A)
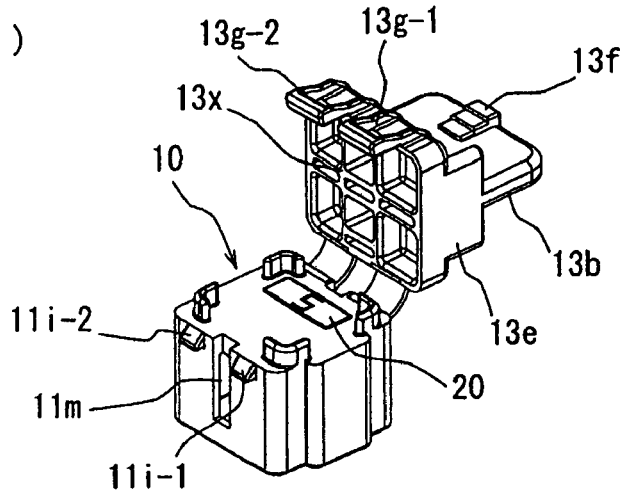
(B)
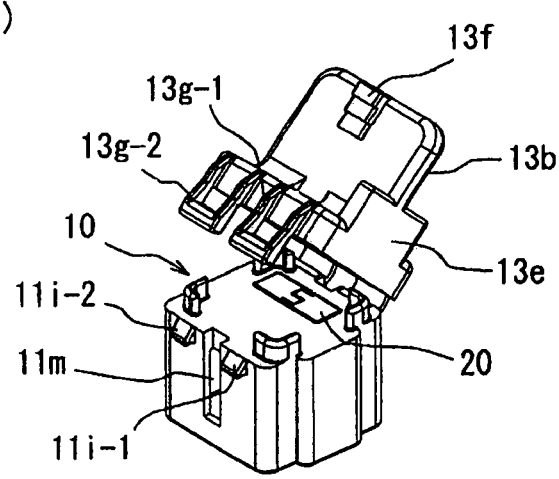
(C)
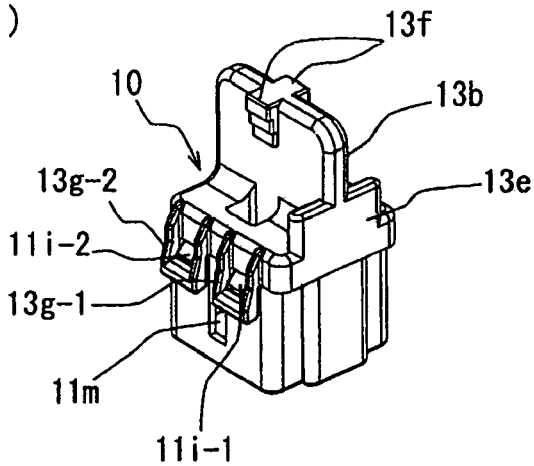

【Fig. 9】
(A)
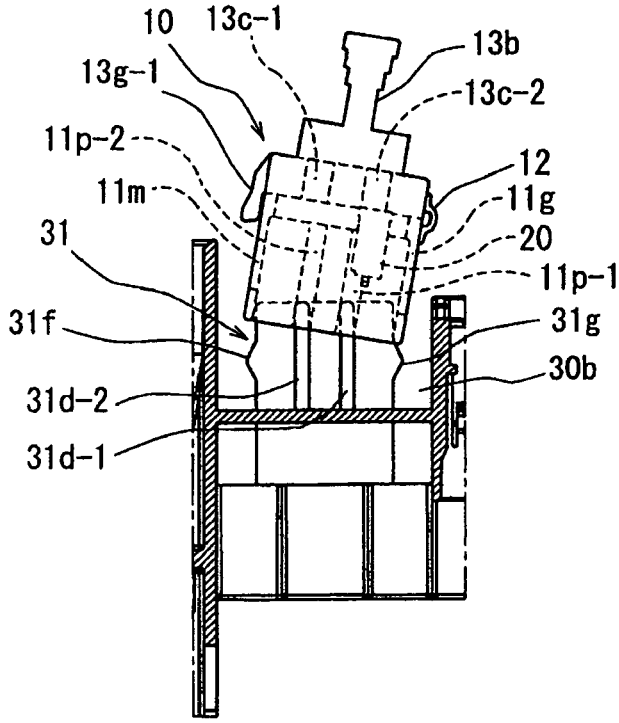
(B)
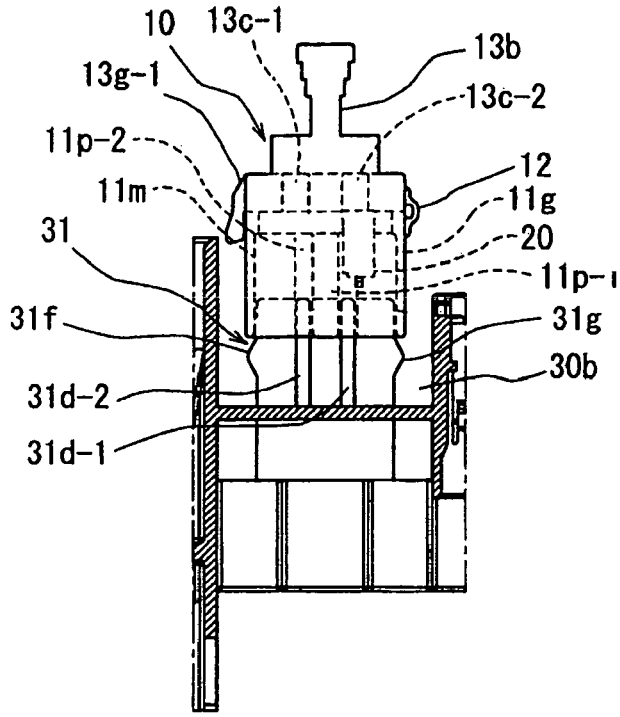

【Fig. 10】
(A)
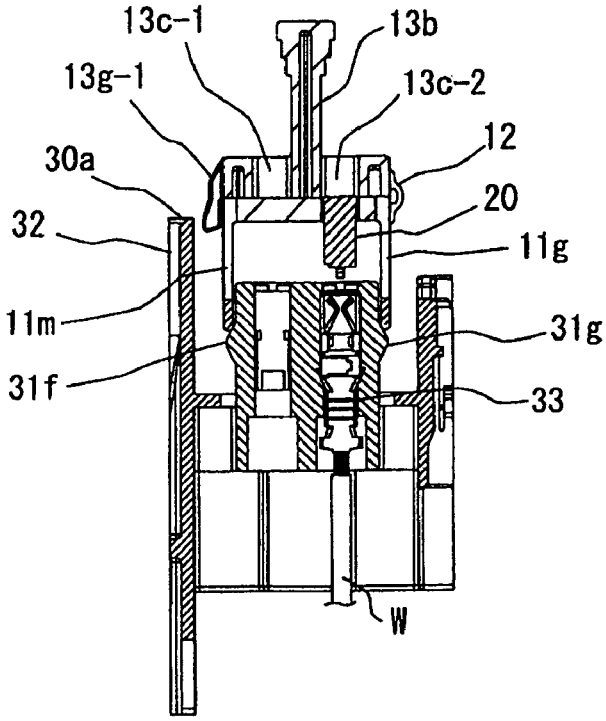
(B)
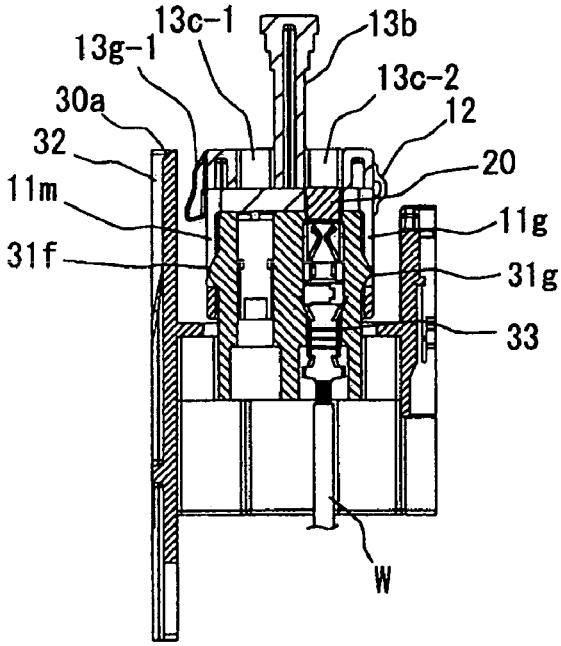

【Fig. 11】
(A)
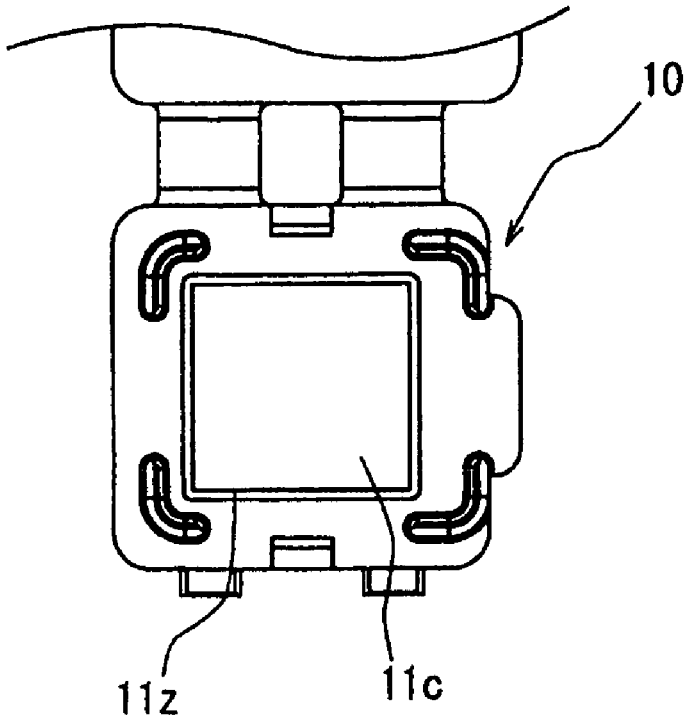
(B)
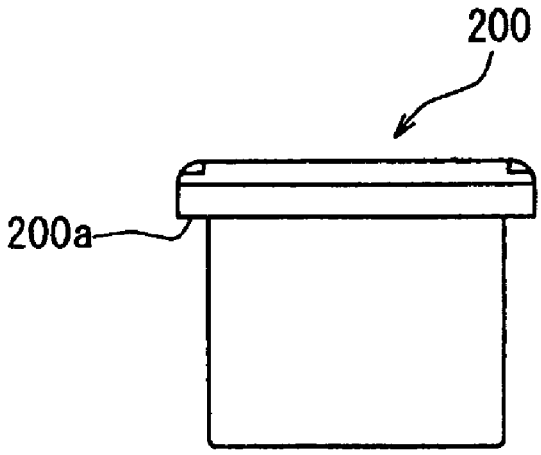

【Fig. 12】
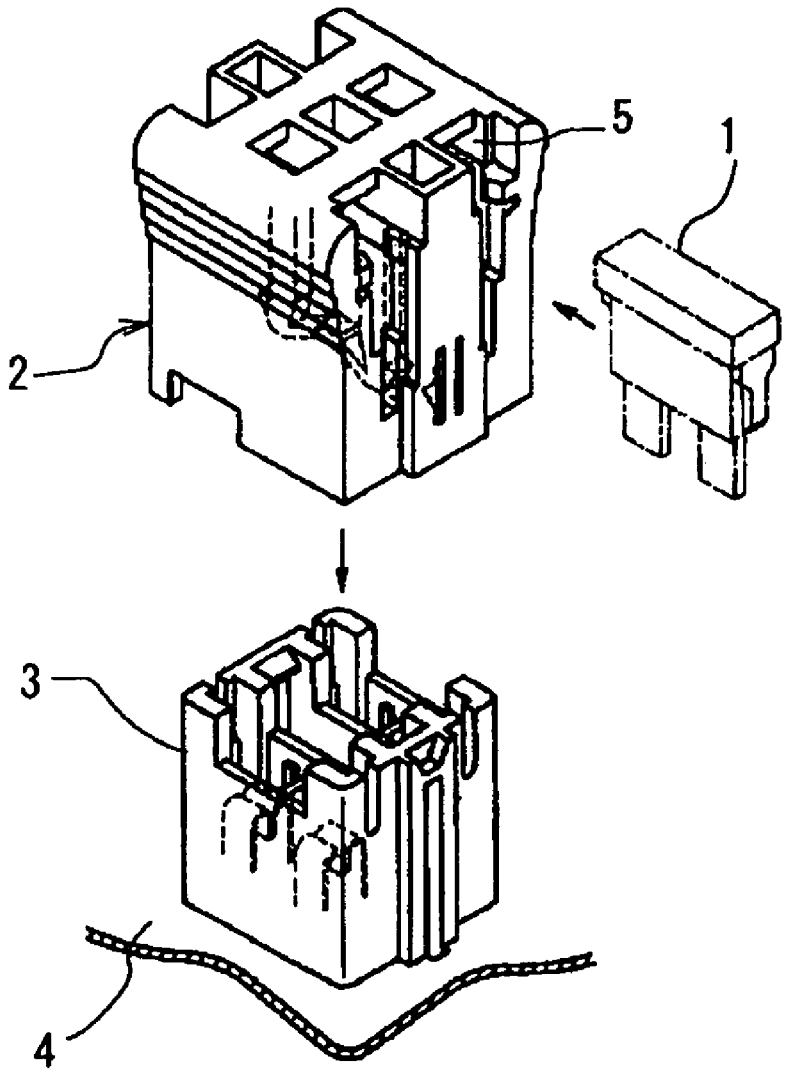

ELECTRICAL COMPONENT HOLDER

The present application claims priority to JP2008-093154 filed in Japan on Mar. 31, 2008, the entire disclosure of which is hereby incorporated by reference in its entirety.

BACKGROUND

1. Technical Field

The exemplary embodiments relate to an electrical component holder for a purpose of vehicle installation, and in more particularly relate to an electrical component holder that contains an electrical component to be retrofitted to an internal circuit in an electrical junction box of an automotive vehicle and enhance workability in attaching the electrical component to an electrical component mounting section of the electrical junction box.

2. Background Art

In an electrical junction box to be mounted on a motor vehicle, an electrical component such as a fuse, a relay, a connector, or the like is attached to the electrical junction box in a producing process of the electrical junction box. However, on account of a circuit construction, there is a case where a relay or the like is attached to the electrical junction box in a motor vehicle assembling process for mounting the electrical junction box on a motor vehicle, namely in a motor vehicle producing maker.

In the case where a fuse, a relay, or the like is attached to a mounting section of the electrical junction box in the motor vehicle assembling process, a working person wears gloves during working. If an electrical component such as a fuse, a relay, or the like is a small size, it would be difficult for gloved fingers to pinch or grasp the electrical component and consequently there is a possibility that the gloved fingers will drop the electrical component.

Also, electrical components to be retrofitted in a motor vehicle by a manufacturer are contained in a box or a bag for transportation. However, a different box or bag, containing an electrical junction box, may be delivered to the manufacturer. There is a possibility that the electrical components interferes with one another in the box or the bag on account of vibrations or the like during transportation and the electrical components will be subject to damages.

SUMMARY

In order to overcome the above problems, it will be possible to take a measure for containing a fuse in a holder so that gloved fingers can readily handle the fuse. For example, in JP HEI 7 (1995)-192600 A, as shown in FIG. 12 in the present application, a fuse 1 is detachably inserted into a through-hole 5 in a fuse holder 2, and the fuse holder 2 that contains the fuse 1 is attached to a fuse block main body 3.

However, because the through-hole 5 in the fuse holder 2 is open at a side wall and the fuse 1 is merely press-fitted in the through-hole 5, there is a possibility that the fuse 1 will drop from the through-hole 5 on account of vibrations during transportation to a motor vehicle producing maker.

Also, there is a case where a check connector is fitted in a fuse mounting section to inspect electrical conductivity in a circuit before the fuse holder is attached to the fuse mounting section and the fuse is retrofitted to the fuse mounting section after inspection of the circuit.

In this case, both of the fuse holder and check connector must be formed into configurations adapted to be coupled to the fuse mounting section.

However, because the fuse block main body 3 disclosed in JP HEI 7 (1995)-192600 A is not designed to receive the check connector and an additional section for mounting the check connector must be provided, the electrical junction box will be upsized.

Problems that the Invention is to Solve

In view of the above problems, one object of the exemplary embodiments is to provide an electrical component holder that can enhance workability in installation of an electrical component to be retrofitted to an electrical junction box.

An auxiliary object of the exemplary embodiments is to provide an electrical component holder that can permit a check connector or the like to be placed on a mounting section of the electrical junction box, before the electrical component holder contains the electrical component and is attached to the mounting section.

Means for Solving the Problems

In order to achieve the above objects, the exemplary embodiments are directed to an electrical component holder that contains an electrical component to be connected to an internal circuit of an automotive vehicle-installed electrical junction box. The electrical component holder includes the electrical component including sections having a terminal member, and a support portion. The electrical component holder further includes a casing main body having a box-like configuration with a lower end defining an opening, an upper wall having a through-hole and an upper surface, and a hollow interior, and a lid mountable on the upper surface of the upper wall of the casing member body. The electrical component is inserted into the through-hole of the upper wall of the casing main body, and the through hole receives and holds the support portion of the electrical component so that the terminal member projects into the hollow interior of the casing main body. The terminal member is disposed in and secured to a terminal aperture of an electrical component mounting section under the condition that the casing main body is attached to the electrical component mounting section.

The electrical component to be contained in the electrical component holder may be a fuse, a fusible link, a relay, a joint connector, a shot pin, or the like.

According to the above construction, when the electrical component holder is attached to the electrical junction box in the motor vehicle assembling process, the electrical component, such as a fuse or a relay, which may be difficult for a working person to pinch by gloved fingers, is contained in the electrical component holder so as to become a great, or larger size, the working person can easily handle the holder by the gloved fingers, thereby enhancing workability in placing the electrical component on the electrical component mounting section.

When the lid is mounted on the casing main body, the lid receives a coupling stress applied from a mating terminal upon insertion into the electrical component mounting section, it is possible to enhance reliability in electrical connection. The lid serves to hold the electrical component in the holder in a given position, thereby preventing the electrical component from dropping off from the holder upon transportation of the electrical component contained in the holder. Thus, because the electrical component is contained at a given position in the electrical component holder, it is possible to prevent or decrease the chances the electrical component being damaged by vibrations during transportation.

In particular, in the case where the electrical component is small in height, such as so-called small height type fuse, because the fuse is very small, the fuse contained in the holder can be handled easily.

Although the lid is separated from the casing main body, in an embodiment, the lid may be integrally formed with the casing main body to decrease of the number of parts.

In an embodiment, the lid may be provided on an upper surface with a pinch knob projecting upward from the upper surface.

According to the above construction, the pinch knob may project from the lid, and a working person who wears gloves can continue to work while the gloved fingers are holding the pinch knob. Accordingly, there is no possibility or a reduced chance that the person may drop the electrical component holder. Even if another electrical component exists near the mounting section, or even if the mounting section is enclosed by a standing wall from the electrical junction box, hands or fingers need not interfere with another electrical component or a wall, thereby facilitating an attaching work of the holder to the electrical component mounting section.

In an embodiment, a height of the pinch knob is 10 to 20 mm. However, it is envisioned that as long as the pinch knob does not interfere with an inner surface of the upper cover when an upper cover is mounted on the casing main body provided with the electrical component mounting section of the electrical junction box, and so long as two opposed sides of the pinch knob are of adequate size to be pinched by two fingers, a height of the pinch knob may be set to be any height.

Furthermore, in an exemplary embodiment, the lid may be provided with visual windows.

As described above, because a condition of the internal electrical component can be confirmed through the visual windows, it is possible to check misconnection of the electrical component, even if the lid closes the casing main body.

In an exemplary embodiment, the lid is closably connected to the casing main body with a hinge. The casing main body has at least one groove disposed on an inner surface of a peripheral wall to be coupled to at least one rib disposed on an outer surface of the electrical component mounting section. The casing main body has at least one lock aperture disposed on the peripheral wall, and the electrical component mounting section has at least one lock pawl disposed on an outer surface of the electrical component mounting section, the lock pawl being inserted into and secured by the lock aperture.

As described above, because the lid is integrally connected with the hinge to the casing main body, there is an advantage that the number of parts is not increased. Even if a different electrical component is mounted on the casing main body, there is no possibility or a reduced chance that the lid will be lost, when the incorrect electrical component is changed to a regular electrical component, because the lid is connected through the lid to the casing main body. After exchanging the electrical components, the lid can be closed, thereby enhancing workability.

Furthermore, because the casing main body is provided in the inner surface of the casing main body with grooves, it is possible to easily and steadily attach the electrical component holder to the electrical component mounting section while the ribs are contacting with the grooves, thereby preventing any damage from being caused by installing the electrical component holder in the casing main body in an inclined position.

In an exemplary embodiment, when the electrical component holder is attached to the electrical component mounting section of the electrical junction box, the grooves in the casing main body are aligned with the ribs of the electrical component mounting section, the electrical component holder is arranged to oppose the electrical component mounting section, and the ribs are inserted into the grooves, the electrical component holder is brought into a vertical position with respect to the electrical component mounting section, and finally the lock pawls of the electrical component mounting section are engaged with the lock apertures in the casing main body.

In an exemplary embodiment, the electrical component mounting section of the electrical junction box to place the electrical component holder shares a check connector mounting section. After a check connector inspects electrical conductivity in a circuit, the electrical component holder is attached to the electrical component mounting section to be connected to the inspected circuit.

That is, the profile of the check connector is same as that of the electrical component holder, and the electrical component contained in the holder can be attached to the check connector mounting section.

In the case where the electrical component is a fuse to be connected to, for example, an ABS circuit, the electrical component mounting section is firstly coupled to a check connector for inspecting a battery oil control circuit in the ABS circuit before the holder containing the fuse is attached to the mounting section. After inspecting the circuit, the check connector is removed from the electrical component mounting section, and the fuse contained in the holder is attached to the mounting section to be connected to the ABS circuit.

Thus, because the check connector and the electrical component holder can be attached to a single common electrical component mounting section of the electrical junction box, it is not necessary to provide an additional electrical component mounting section, thereby downsizing a whole electrical junction box.

EFFECTS OF THE INVENTION

As described above, the electrical component to be contained in the electrical component holder is retrofitted to the electrical junction box in the motor vehicle assembling process different from the producing process for the electrical junction box. According to the exemplary embodiments, because the electrical component, which is hard for a working person to pinch it by gloved fingers, is contained in the electrical component holder so as to become a great size, the working person can easily handle the holder by the gloved fingers, thereby enhancing workability in placing the electrical component on the electrical component mounting section.

Because the lid is mounted on the casing main body, the lid receives a coupling stress applied from a mating terminal upon insertion into the electrical component mounting section, it is possible to enhance reliability in electrical connection between the electrical component, such as a fuse, a relay, or the like, and the circuit member in the electrical junction box. The lid serves to hold the electrical component in the holder in a given position, thereby preventing the electrical component from dropping off from the holder upon transportation of the electrical component contained in the holder.

Furthermore, because the lid is provided with the pinch knob and a working person who wears the gloves can continue to work, there is no possibility that the person will drop the electrical component holder from the gloved fingers. Even if another electrical component exists near the electrical component mounting section, or even if the mounting section is enclosed by a standing wall or the like from the electrical junction box, the hands or fingers do not interfere with the another electrical component or the peripheral wall, thereby facilitating a work for attaching the electrical component to the electrical component mounting section.

Because the lid is provided with the visual windows, it is possible to confirm a condition of the internal electrical component through the windows, thereby checking misconnection of the electrical component while the lid closes the casing main body.

Because the casing main body is provided in the peripheral wall with the grooves, it is possible to easily and steadily attach the electrical component holder to the electrical component mounting section while the ribs of the electrical component mounting section are entering the grooves, thereby preventing the damage from being caused by installation of the electrical component holder in an inclined position.

Furthermore, because the mounting section for the check connector in the electrical junction box is formed into a configuration that can receive the holder containing the electrical component, it is not necessary to provide an additional check connector mounting section on the electrical junction box, thereby simplifying a configuration of the electrical junction box and downsizing the box.

BRIEF DESCRIPTION OF THE DRAWINGS

FIG. 1 is a perspective view of an electrical component holder according to the exemplary embodiments and an electrical component mounting section of an electrical junction box;

FIG. 2 is a sectional view of the electrical component mounting section, illustrating the mounting section on which a check connector is fitted;

FIG. 3A is a front elevation view of a fuse;

FIG. 3B is a right side elevation view of the fuse shown in FIG. 3A;

FIG. 4A is a plan view of the electrical component holder, illustrating the holder in which a lid is opened;

FIG. 4B is a longitudinal section view of the electrical component holder taken along lines A-A in FIG. 4A;

FIG. 5A is a front elevation view of the electrical component holder shown in FIGS. 4A and 4B;

FIG. 5B is a bottom view of the electrical component holder shown in FIG. 4A;

FIG. 6A is a longitudinal section view of the electrical component holder, illustrating the holder in which a fuse is contained;

FIG. 6B is a cross section view of the electrical component holder, illustrating the holder in which a fuse is contained;

FIG. 7 is a sectional view of the electrical component mounting section Of an electrical junction box;

FIGS. 8A to 8C are perspective views of the electrical component holder, illustrating steps of closing a lid onto the holder;

FIGS. 9A and 9B are sectional views of the electrical component mounting section, illustrating a step of beginning to insert an electrical component into the mounting section;

FIGS. 10A and 10B are sectional views of the electrical component mounting section, illustrating a step of finishing inserting an electrical component into the mounting section;

FIG. 11A is a plan view of an alteration of a main part of the electrical component holder in accordance with the exemplary embodiments;

FIG. 11B is a front elevation view of a fusible link to be contained in the altered electrical component holder; and FIG. 12 is an exploded perspective view of a prior art electrical component holder.

DETAILED DESCRIPTION OF EMBODIMENTS

Referring now to the drawings, embodiments of an electrical component holder will be described below.

As shown in FIGS. 1-10, the electrical component holder 10 of the exemplary embodiments serves as a fuse holder for containing a fuse 20. The electrical component holder 10 is attached to an electrical junction box 30 to be mounted on a motor vehicle and serves to connect the fuse 20 to an internal circuit in the electrical junction box 30. After the electrical junction box 30 has been produced in a producing process, the electrical component holder 10 is retrofitted to the electrical junction box 30 in an assembling process for a motor vehicle.

As shown in FIG. 1, a casing 32 of the electrical junction box 30 is provided on an upper surface with an electrical component mounting section 31 for placing the electrical component holder 10 thereon. A terminal 33 (FIG. 7) projects into the electrical component mounting section 31. The terminal 33 is made of an internal circuit member, such as a bus bar or the like, contained in the electrical junction box 30. An internal circuit provided with the terminal 33 includes a battery oil control circuit (not shown) in an ABS circuit. Before the terminal 33 is connected to the fuse 20, a check connector 40, as shown in FIG. 2, is connected to the electrical component mounting section 31, in order to inspect the battery oil control circuit described above.

That is, the electrical component mounting section 31 can receive the check connector 40 as well as the electrical component holder 10. In other words, a profile of the electrical component holder 10 is substantially same as that of the check connector 40.

The fuse 20 to be contained in the electrical component holder 10 may be a small height type fuse. As shown in FIGS. 3A and 3B, the fuse 20 includes an input terminal member 20*a*, an output terminal member 20*b*, a fuse element (not shown) having a fusible portion (not shown) connected between the input and output terminal members 20*a*, 20*b*, and a support portion 20*c* for fixing the fuse element therein. The support portion 20*c* includes a fuse main body 20*f*, right and left wings 20*g*, 20*g*, and right and left stepped portions 20*e*, 20*d* to form a T-shaped configuration. The input and output terminals 20*a* and 20*b* project from the stepped portions 20*d* and 20*e* to form a fuse having a small size in height.

As shown in FIG. 4A, the electrical component holder 10 is a resin molding product including a casing main body 11, a thin hinge 12 provided on an upper wall 11*b* of the casing main body 11, and a lid 13 closably connected through the hinge 12 to the casing main body 11. The electrical component holder 10 is formed into a substantially rectangular parallelepiped configuration so that a working person can handle the holder 10 by the person's gloved fingers (for example, a size of 20 mm in width, length, and height).

As shown in FIG. 4B, the casing main body 11 is formed into a box-like configuration that is open at a lower end and defines a hollow interior 11*a*. The casing main body 11 is provided in the upper wall 11*b* at a side of the hinge 12 with a through-hole 11*c* having a substantially rectangular shape with opposed long sides 11*r* and opposed short sides 11*s*. The through-hole 11*c* receives and locks the support portion 20*c* for the input and output terminals 20*a* and 20*b* of the fuse 20 so that the input and output terminals 20*a* and 20*b* project into the hollow interior 11*a*, as shown in FIGS. 6A and 6B.

The through-hole 11*c* is provided on four corners with engaging portions 11*d*-1 to 11*d*-4 that engage the stepped portions 20*d*, 20*e* of the fuse 20. A pair of ribs 11*e*-1, 11*e*-2 are provided on each long side 11*r* between the engaging portions 11*d*-I and 11*d*-4, and 11*d*-2 and 11*d*-3, while a pair of ribs 11*f*-1, 11*f*-2 are provided on each short side 11*s* between the engaging portions 11*d*-1 and 11*d*-2, and 11*d*-4 and 11*d*-3. The ribs 11*e*-1, 11*e*-2 provided on the long side 11*r* engage front and rear surfaces of the fuse main body 20*f* of the fuse 20 while the ribs 11*f*-1, 11*f*-2 provided on the short side 11*s* engage opposite side surfaces of the fuse main body 20*f* of the fuse 20.

The casing main body 11 is provided with lock apertures 11*g* and 11*m* in a peripheral wall 11*j* at the side of the hinge 12 of the casing main body 11 and in a peripheral wall 11*k* opposed to the peripheral wall 11*j*. The lock apertures 11*g*, 11*m* extend downward from the upper wall 11*b* of the casing main body 11 so that the fusible portion of the fuse 20 can be viewed. Lock pawls 31*f* and 31*g* provided on an outer surface of the electrical component mounting section 31 described in more detail below are inserted into the lock apertures 11*g*, 11*m*. As shown in FIG. 5A, the peripheral wall 11*k* is provided on an upper end with lock pawls 11*i*-1, 11*i*-2 at the opposite sides of the lock aperture 11*m*. The lock pawls 11*i*-1 and 11*i*-2 serve to engage lock frames 13*g*-1 13*g*-2 of the lid 13 described in more detail below.

The casing main body 11 is provided on four corners on the upper wall 11*b* with L-shaped positioning ribs 11*n*-1 to 11*n*-4 so that the ribs can prevent the lid 13 from being extremely twisted when the lid 13 is mounted on the upper wall 11*b*.

As shown in FIG. 5B, the casing main body 11 is provided on one of inner peripheral surfaces enclosing the hollow interior 11*a* with a pair of grooves 11*p*-1, 11*p*-2 extending in a vertical direction. Ribs 31*d*-1 and 31*d*-2 (described in more detail below) provided on an outer surface of the electrical component mounting section 31 are fitted in the grooves 11*p*-1, 11*p*-2, when the casing main body 11 is mounted and locked on the electrical component mounting section 31 of the electrical junction box 30. The grooves 11*p*-1, 11*p*-2 are disposed to form an outward bulge in a peripheral wall of the casing main body 11.

As shown in FIG. 4A, the lid 13 includes a lid main body 13*a*, a grid-like push rib 13*x* that contacts with an upper surface 20*h* (FIG. 3A) of the fuse 20 and the upper wall 11*b* of the casing main body 11, and a pinch knob 13*b* standing up from a substantially central part of an outer surface of the lid main body 13*a*.

The lid main body 13*a* is provided on opposite sides on a proximal end of the pinch knob 13*b* with rectangular visual windows 13*c*-1 and 13*c*-2. The visual windows 13*c*-1 and 13*c*-2 utilize mold-release apertures that are generated to form latching portions described after. The visual windows 13*c*-1, 13*c*-2 are disposed on a position where an ampere number indicated on the upper surface 20*h* of the fuse 20 can be viewed.

The pinch knob 13*b* is provided on an end with a misdirection preventing rib 13*e* that projects from and continues to the peripheral wall 13*d* of the lid main body 13*a*. The misdirection preventing rib 13*e* indicates a regular direction of the electrical component holder 10 with respect to the electrical component mounting section 31.

The pinch knob 13*b* is provided on opposite sides of an upper part with anti-slip latches 13*f*. Each of the anti-slip latches 13*f* extends from an upper part of the pinch knob 13*b* to an intermediate part on each side surface of the pinch knob 13*b*. Since a flat surface is formed on each side surface of the pinch knob 13*b*, the pinch knob 13*b* can be readily held by fingers of a working person.

Each anti-slip latch 13*f* may extend from the upper part of the pinch knob 13*b* to an upper surface of the lid main body 13*a*. So long as the latches 13*f* do not lose an anti-slip effect, a length of each latch 13*f* is not limited.

Lock frames 13*g*-1 and 13*g*-2 project from a lower end of a lid peripheral wall 13*d* opposed to the hinge 12. The lock pawls 11*i*-1 and 11*i*-2 are provided on the casing main body 11 at positions corresponding to the lock frames 13*g*-1 and 13*g*-2.

As shown in FIG. 7, the electrical component mounting section 31 of the electrical junction box 30 stands up on an electrical component containing section 30*b* enclosed by a peripheral wall 30*a*. The electrical component mounting section 31 is formed into a substantially cubic box-like configuration and is provided on an upper wall 31*a* with two terminal apertures 31*b* (31*b*-1 and 31*b*-2) into which the input and output terminal members 20*a* and 20*b* of the fuse 20 are inserted. A terminal 33 connected to an end of an electrical wire W in the ABS circuit is secured to the one terminal aperture 31*b*-1.

The electrical component mounting section 31 is provided on the peripheral wall at a position opposed to the grooves 11*p*-1 and 11*p*-2 in the electrical component holder 10 with a pair of ribs 31*d*-1 and 31*d*-2 extending in a vertical direction. Also, opposed peripheral walls 31*e*-1 and 31*e*-2 of the electrical component mounting section 31 are provided at positions corresponding to the lock apertures 11*m* and 11*g* with lock pawls 31*f* and 31*g*.

Next, a process for attaching the electrical component holder 10 to the electrical component mounting section 31 will be described below.

As shown in FIGS. 8A to 8C, the fuse 20 is inserted into the casing main body 11 of the electrical component holder 10, the fuse 20 is pushed into the casing main body 11 until the stepped portions 20*d* and 20*e* of the fuse 20 contact with the engaging portions 11*d*-1 to 11*d*-4 in the through-hole 11*c*, and the ribs 11*e*-1, 11*e*-2, 11*f*-1, 11*f*-2 press the support portion 20*c* of the fuse 20 from four directions.

Next, the casing main body 11 is closed by the lid 13 through the hinge 12, the lock frames 13*g*-1 and 13*g*-2 of the lid 13 are engaged with the lock pawls 11*i*-1 and 11*i*-2 of the casing main body 11, and the push rib 13*x* provided on the inner surface of the lid main body 13*a* may make contact with the upper wall 11*b* of the casing main body 11 and with the upper surface 20*h* of the fuse 20. That is, when the electrical component holder 10 holds the fuse 20 in the vertical and horizontal directions, the fuse 20 can be steadily fixed in the holder 20.

Under this condition, the electrical component holder 10 is transported to and delivered at a motor vehicle producing maker that assembles motor vehicles.

Next, an assembling work in a motor vehicle assembling process will be described below.

Before the electrical component holder 10 is attached to the electrical component mounting section 31, the check connector 40 is attached to the electrical component mounting section 31 to inspect the battery oil control circuit in the ABS circuit. After inspecting, the check connector 40 is removed from the electrical component mounting section 31.

Then, the electrical component holder 10 containing the fuse 20 is inserted into the electrical component mounting section 31 while the grooves 11*p*-1, 11*p*-2 in the inner peripheral surface of the holder 10 are contacting with the ribs 31*d*-1, 31*d*-2 of the electrical component mounting section 31. At this time, even if the electrical component holder 10 is inserted into the electrical component mounting section 31 in an inclined position, as shown in FIG. 9A, the grooves 11*p*-1, 11*p*-2 and the ribs 31*d*-1, 31*d*-2 cooperate to restrain the inclined position, as shown in FIG. 9B. Consequently, the electrical component holder 10 is disposed in the electrical component mounting section 31 in a vertical position, and the lower end of the peripheral wall 11*k* of the electrical component holder 10 contacts with the upper ends of the lock pawls 31*f*, 31*g* provided on the peripheral walls 31*e*-1, 31*e*-2 of the electrical component mounting section 31, so that the fuse 20 is disposed in a vertical position with respect to the terminal 33 of the electrical component mounting section 31.

Then, when the electrical component holder 10 is further pushed down into the electrical component mounting section 31, the lock pawls 31*f*, 31*g* are engaged with the lock apertures 11*m*, 11*g* in the electrical component holder 10. Thus, the input and output terminal members 20*a* and 20*b* of the fuse 20 are smoothly connected to the terminal 33 of the electrical component mounting section 31 without causing any damages on the terminal 33.

As described above, usually, a working person is hard to grip the fuse 20 by globed fingers in the motor vehicle assembling process. However, because the electrical component holder 10 is attached to the electrical junction box 30, the fuse 20 contained in the electrical component holder 10 having a size greater than that of the fuse 20, gloved fingers can easily handle the holder 10, thereby enhancing workability in placing the fuse 20 on the electrical component mounting section 31.

Because the lid 13 is provided on the casing main body 11, even if fuse 20 is pushed out from the terminal apertures 22*c* upon inserting the electrical component holder 10 into the electrical component mounting section 31, the lid 13 will push down the fuse 20, the fuse 20 is not ejected from the through-hole 13*c* in the casing main body 11 toward the lid 13, thereby preventing the fuse 20 from dropping off upon transportation.

Furthermore, because the pinch knob 13*b* projects from the lid 13, a working person can continue to work while the person is holding the pinch knob 13*b*. Accordingly, the chance that the person may drop the electrical component holder 10 is reduced or eliminated, and thus the electrical component holder 10 can be readily attached to the electrical component mounting section 31. Also, because the lid 13 is provided with the visual windows 13*c*-1, 13*c*-2 for the fuse 20, it is possible to check misconnection of the fuse 20. In addition, because the casing main body 11 is provided with grooves 11*p*-1, 11*p*-2, it is possible to easily and steadily attach the electrical component holder 10 to the electrical component mounting section 31 while the ribs 31*d*-1, 31*d*-2 of the electrical component mounting section 31 are inserted into the grooves 11*p*-1, 11*p*-2, thereby preventing the electrical component holder 10 from causing any damage to the terminal on account of to inclined insertion.

Furthermore, because the electrical component mounting section 31 of the electrical junction box 30 is shared with a fitting section for a check connector that inspects the battery oil control circuit, it is not necessary to provide any additional check connector fitting section, thereby downsizing the electrical junction box 30.

The exemplary embodiments described herein are not limited to the above disclosure. The exemplary embodiments, for example, can be applied to a holder 10 for a fusible link 200 shown in FIGS. 11A and 11B.

Because, the fusible link 200 has greater size and weight than those of the fuse 20, a casing main body 11 is provided on a whole periphery with a continuous engaging portion 11*z* without providing the casing main body 11 with separated engaging portions 11*d*-1 to 11*d*-4 in the case of the fuse folder 10. When a whole periphery of a flange 200*a* of the fusible link 200 contacts with the engaging portion 11*z*, the fusible link 200 can be steadily contained in the holder 10.

Because the other constructions and operational effects in this alteration are the same as those in the above embodiment, duplicated descriptions are omitted here.

What is claimed is:

1. An electrical component holder that contains an electrical component to be connected to an internal circuit of an electrical junction box for an automotive vehicle, the electrical component holder comprising:

the electrical component including sections having:

a terminal member, and a support portion; and a casing main body having a box-like configuration with a lower end defining an opening, an upper wall having a through-hole and an upper surface, and a hollow interior, and a lid mountable on the upper surface of the upper wall of the casing main body, the lid having a misdirection preventing projection rib provided on an end of a top surface of the lid and a pinch knob disposed on the top surface of the lid so that the pinch knob projects upward from the top surface, wherein the electrical component is inserted into the through-hole of the upper wall of the casing main body, and the through hole receives and holds the support portion of the electrical component so that the terminal member projects into the hollow interior of the casing main body, and the terminal member being disposed in and secured to a terminal aperture of an electrical component mounting section under the condition that the casing main body is attached to the electrical component mounting section.

2. The electrical component holder of claim 1, wherein the lid is provided with visual windows.

3. The electrical component holder of claim 1, wherein the lid is closably connected with a hinge to said casing main body.

4. The electrical component holder of claim 1, wherein the casing main body has at least one groove disposed on an inner surface of a peripheral wall, the casing main body and at least one rib disposed on an outer surface of the electrical component mounting section, the rib being coupled to the groove.

5. The electrical component holder of claim 1, wherein the casing main body has at least one aperture disposed on the peripheral wall of the casing main body, and the electrical component mounting section has at least one lock pawl disposed on the outer surface of the electrical component mounting section, the lock pawl being inserted into and secured by the lock aperture.

6. The electrical component holder of claim 1, wherein the lid includes a bottom surface having a push rib that contacts a top surface of the support portion of the electrical component and the upper surface of the casing main body.

7. The electrical component holder of claim 1, wherein the misdirection preventing projection rib extends substantially perpendicular to the pinch knob and along a periphery of the top surface of the lid.

8. The electrical component holder of claim 1, further comprising:

a check connector, for inspecting the internal circuit, the electrical component mounting section being connectable to the check connector and the electric component holder.

9. A method of attaching the electrical component holder of claim 8 to the internal circuit of the electrical junction box for the automotive vehicle, the method comprising:

inspecting a circuit with a check connector; and attaching the electric component holder to the electrical component mounting section after inspecting the circuit so that the electric component mounting section is connected to the check connector and the electric component holder.

* * * * *